US007028573B2

(12) United States Patent
Inaba et al.

(10) Patent No.: US 7,028,573 B2
(45) Date of Patent: Apr. 18, 2006

(54) OPENING AND CLOSING DEVICE

(75) Inventors: Yasuhisa Inaba, Handa (JP); Katsuaki Kadoike, Kariya (JP); Masumi Nishikawa, Toyoake (JP); Satoshi Isobe, Kariya (JP); Hideyuki Nagai, Chiryu (JP); Masahiro Kojima, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 284 days.

(21) Appl. No.: 10/421,932

(22) Filed: Apr. 24, 2003

(65) Prior Publication Data

US 2004/0020319 A1 Feb. 5, 2004

(30) Foreign Application Priority Data

Apr. 24, 2002 (JP) ..... 2002-122157

(51) Int. Cl.
*B25J 5/10* (2006.01)
*E05F 15/10* (2006.01)

(52) U.S. Cl. ..... 74/409; 74/530; 74/421 A

(58) Field of Classification Search ..... 74/409, 74/440, 443, 530, 531, 425, 421 A
See application file for complete search history.

(56) References Cited

U.S. PATENT DOCUMENTS

| | | | | |
|---|---|---|---|---|
| 2,627,118 | A * | 2/1953 | Young | 33/832 |
| 4,688,448 | A * | 8/1987 | Hollis et al. | 74/665 L |
| 5,063,808 | A * | 11/1991 | Hill | 74/411.5 |
| 6,446,390 | B1 | 9/2002 | Bandemer et al. | |

FOREIGN PATENT DOCUMENTS

| | | |
|---|---|---|
| DE | 298 14 419 | 12/1998 |
| GB | 1077146 | 7/1967 |
| GB | 1 584 116 | 3/1969 |
| JP | 2000-335245 A | 12/2000 |
| WO | WO 00/36259 | 6/2000 |

* cited by examiner

*Primary Examiner*—William C. Joyce
(74) *Attorney, Agent, or Firm*—Buchanan Ingersoll PC

(57) ABSTRACT

An opening and closing device for moving a movable member which includes a drive gear connected to a power source, a driven gear geared with the drive gear, an immovable portion supporting the drive gear and the driven gear, and a dynamic transmission mechanism connected to the driven gear so that the driven gear and the dynamic transmission mechanism rotate together as a unit. The dynamic transmission mechanism transmits a drive force of the power source from the driven gear to the movable member. A direction of a rotational force affecting the driven gear via the dynamic transmission mechanism in accordance with a state of the movable member fluctuates. The opening and closing device further includes a friction member located at least at one position between relatively movable facing surfaces of the immovable portion, the drive gear, the driven gear, and the dynamic power transmission mechanism.

7 Claims, 9 Drawing Sheets

OPENING AND CLOSING DEVICE

This application is based on and claims priority under 35 U.S.C. § 119 with respect to Japanese Patent Application No. 2002-122157 filed on Apr. 24, 2002, the entire contents of which are incorporated herein by reference.

FIELD OF THE INVENTION

The present invention generally relates to an opening and closing device. More particularly, the present invention pertains to an opening and closing device associated with a movable member (e.g., a vehicle door) for moving the movable member (e.g., opening and closing the vehicle door) using a gear actuation.

BACKGROUND OF THE INVENTION

A known opening and closing device for a movable member (opening and closing body) is disclosed in Japanese Patent Laid-Open Publication No. 2000-335245. The known opening and closing device disclosed in Japanese Patent Laid-Open Publication No. 2000-335245 is applied to a backdoor provided on a rear portion of a vehicle as the opening and closing device of the movable member.

The opening and closing device disclosed in Japanese Patent Laid-Open Publication No. 2000-335245 includes a drive mechanism provided on a vehicle body side and an operation transmission mechanism for connecting the drive mechanism and the backdoor. The backdoor is opened and closed by transmitting the drive force of the drive mechanism to the backdoor via the operation transmission mechanism. The output of an electric motor included in the drive mechanism is transmitted to the operation transmission mechanism by the gear connection.

The opening and closing of the backdoor is generally assisted by a damper stay. The damper stay corresponds to a gas piston sealed with high pressure gas. The damper stay generates a resultant force in the closing direction added with the weight of the backdoor per se during the first half of the operation for opening the backdoor to prevent the sudden door opening. On the other hand, the damper stay assists to open the door by generating the resultant force in the opening direction added with the weight of the backdoor per se during the last half of the operation for opening the backdoor.

FIGS. 9*a*, 9*b* show the dynamic transmission between a drive gear (i.e., a gear on a motor side) 91 and a driven gear (i.e., a gear on a door side) 92 of the drive mechanism. FIG. 9*a* shows the first half of the door opening operation. FIG. 9*b* shows the last half of the door opening operation. For explanatory purpose, distances between adjacent gear teeth 91*a* of the drive gear 91 and distances between adjacent gear teeth 92*a* of the driven gear 92 are exaggerated. As shown in FIG. 9*a*, a force is applied to the driven gear 92 tending to urge the driven gear 92 in the counter direction to the rotational direction of the drive gear 91 during the first half of the door opening operation of the backdoor because the backdoor affecting the driven gear 92 applies a force in the closing direction during the first half of the door opening operation. Thus, the driven gear 92 follows the rotation of the drive gear 91 pushing the gear teeth 92*a* of the driven gear 92 with the gear teeth 91*a* thereof. Accordingly, the backdoor is moved in the opening direction via the driven gear 92.

On the other hand, as shown in FIG. 9*b*, during the last half of the door opening operation, when the backdoor is moved to a position exceeding a position balancing the force of the damper stay and the weight of the backdoor per se, the backdoor applies a force in the opening direction to urge the driven gear 92 in the same rotational direction as the drive gear 91. Because of the fluctuation in the rotational direction of the force applied to the driven gear 92 by virtue of the weight of the backdoor at the damper stay, the driven gear 92 moves within a backlash range relative to the drive gear 91 to suddenly move the backdoor. This deteriorates the smooth swinging movement of the door opening operation.

A need thus exists for an opening and closing device of an movable member for performing a relatively smooth opening and closing operation by restraining undesirable sudden swinging movement of the movable member.

SUMMARY OF THE INVENTION

In light of the foregoing, the present invention provides an opening and closing device for moving a movable member which includes a drive gear connected to a power source, a driven gear geared with the drive gear, an immovable portion supporting the drive gear and the driven gear, and a dynamic transmission mechanism connected to the driven gear so that the driven gear and the dynamic transmission mechanism rotate together as a unit. The dynamic transmission mechanism transmits a drive force of the power source from the driven gear to the movable member. A direction of a rotational force affecting the driven gear via the dynamic transmission mechanism in accordance with a state of the movable member fluctuates. The opening and closing device further includes a friction member located at least at one position between relatively movable facing surfaces of the immovable portion, the drive gear, the driven gear, and the dynamic power transmission mechanism.

According to another aspect of the present invention, an opening and closing device for moving a movable member includes a drive gear connected to a power source, a driven gear geared with the drive gear, an immovable portion supporting the drive gear and the driven gear, a dynamic transmission mechanism, connected to the driven gear so that the driven gear and the dynamic transmission mechanism rotate together as a unit, the dynamic transmission mechanism transmitting a drive force of the power source from the driven gear to the movable member, and a shock absorbing member for applying a force to the movable member in accordance with a state of the movable member. A direction of a rotational force affecting the driven gear via the dynamic transmission mechanism in accordance with a resultant force from a weight of the movable member and the shock absorbing member fluctuates. The opening and closing device further includes a friction member applied at least at one position between relatively movable facing surfaces of the immovable portion, the drive gear, the driven gear, and the dynamic power transmission mechanism.

According to further aspect of the present invention, an opening and closing device for moving a movable member includes a drive gear connected to a power source, a driven gear geared with the drive gear, a housing supporting the drive gear and the driven gear, and an arm, connected to the driven gear so that the driven gear and the arm rotate together as a unit. The arm transmits a drive force of the power source from the driven gear to the movable member. A direction of a rotational force affecting the driven gear via the arm in accordance with a state of the movable member fluctuates. The opening and closing member further includes a friction member located at least at one position between relatively movable facing surfaces of the housing, the drive gear, the driven gear, and the arm.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

Figure 9A:
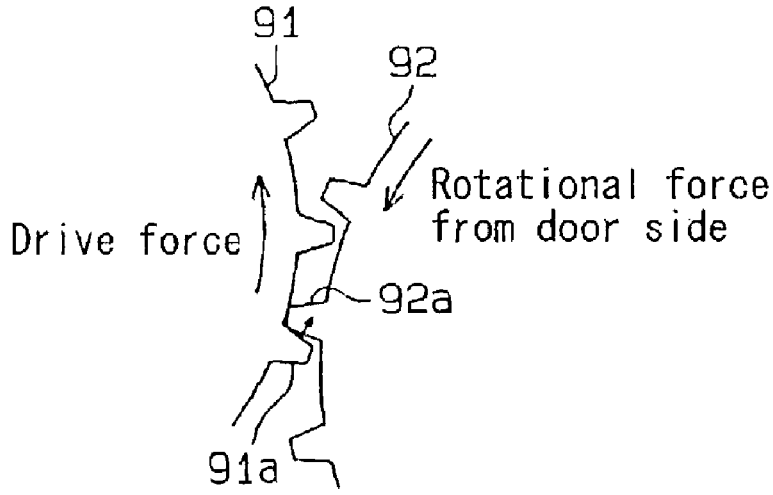

FIG. 9*a* is an explanatory illustration for purpose of explaining the dynamic transmission of the drive gear and the driven gear during the first half of the door opening operation.

Figure 9B:
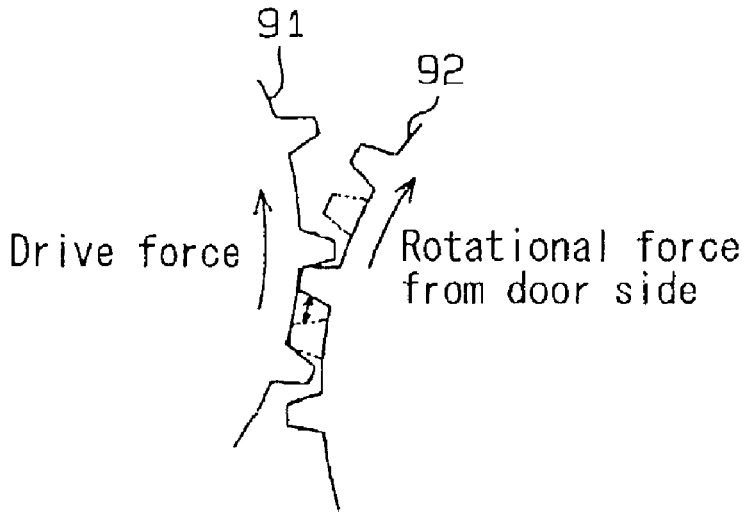

FIG. 9*b* is an explanatory illustration for purpose of explaining the dynamic transmission of the drive gear and the driven gear during the last half of the door opening operation.

DETAILED DESCRIPTION OF THE INVENTION

Figure 2:
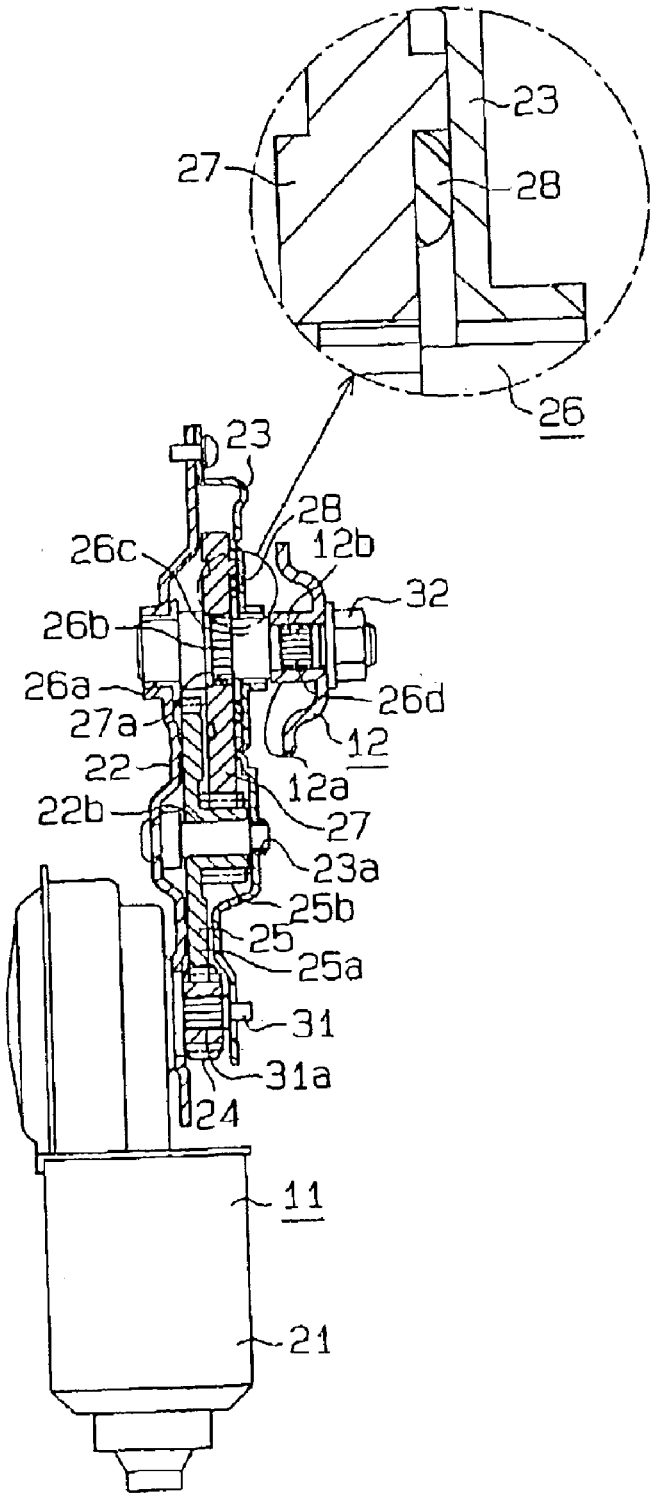
FIG. 2 is a partial cross-sectional view of the opening and closing device according to the first embodiment of the present invention.
Figure 3:
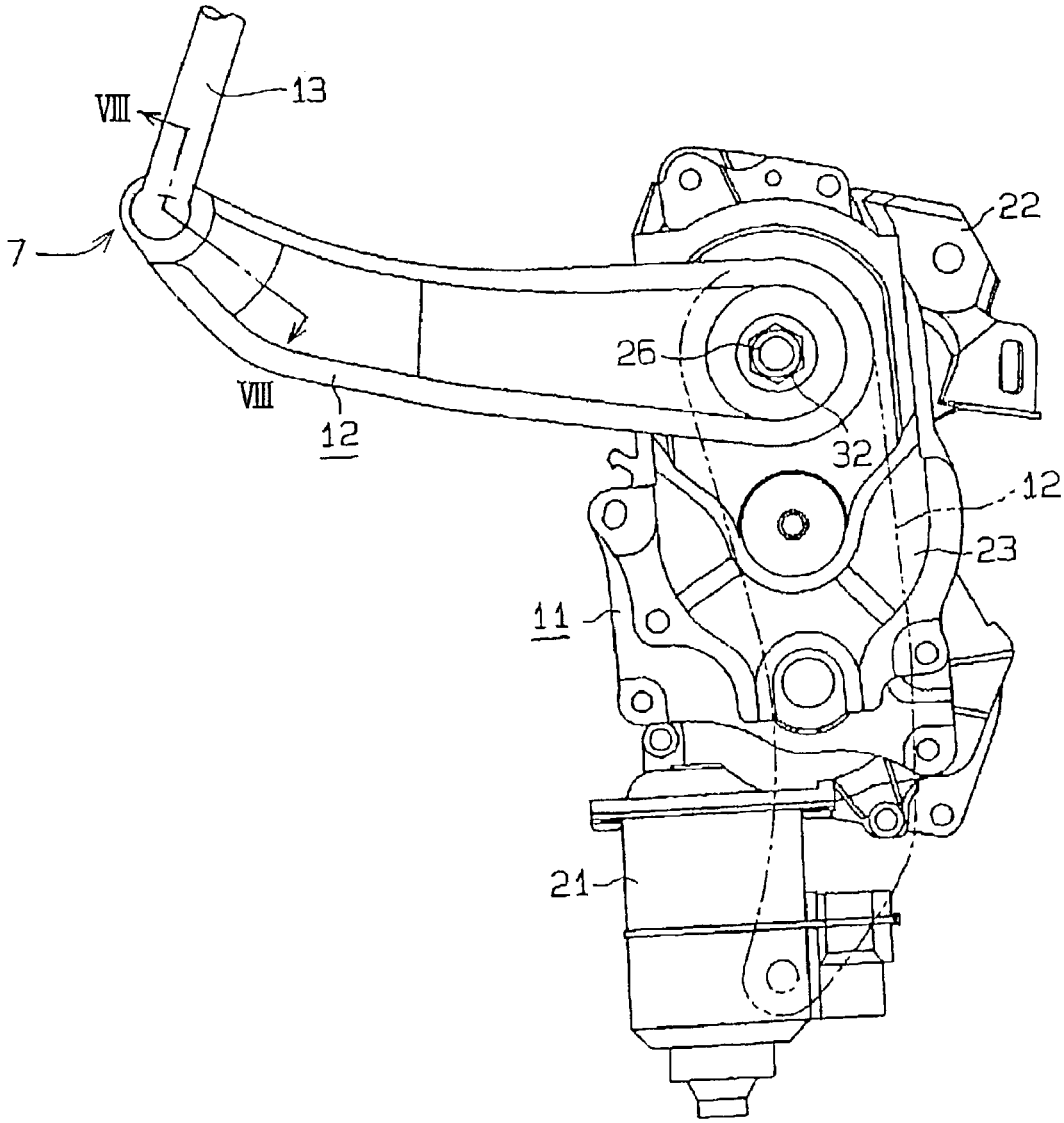
FIG. 3 is a front view of the opening and closing device according to the first embodiment of the present invention.
Figure 4:
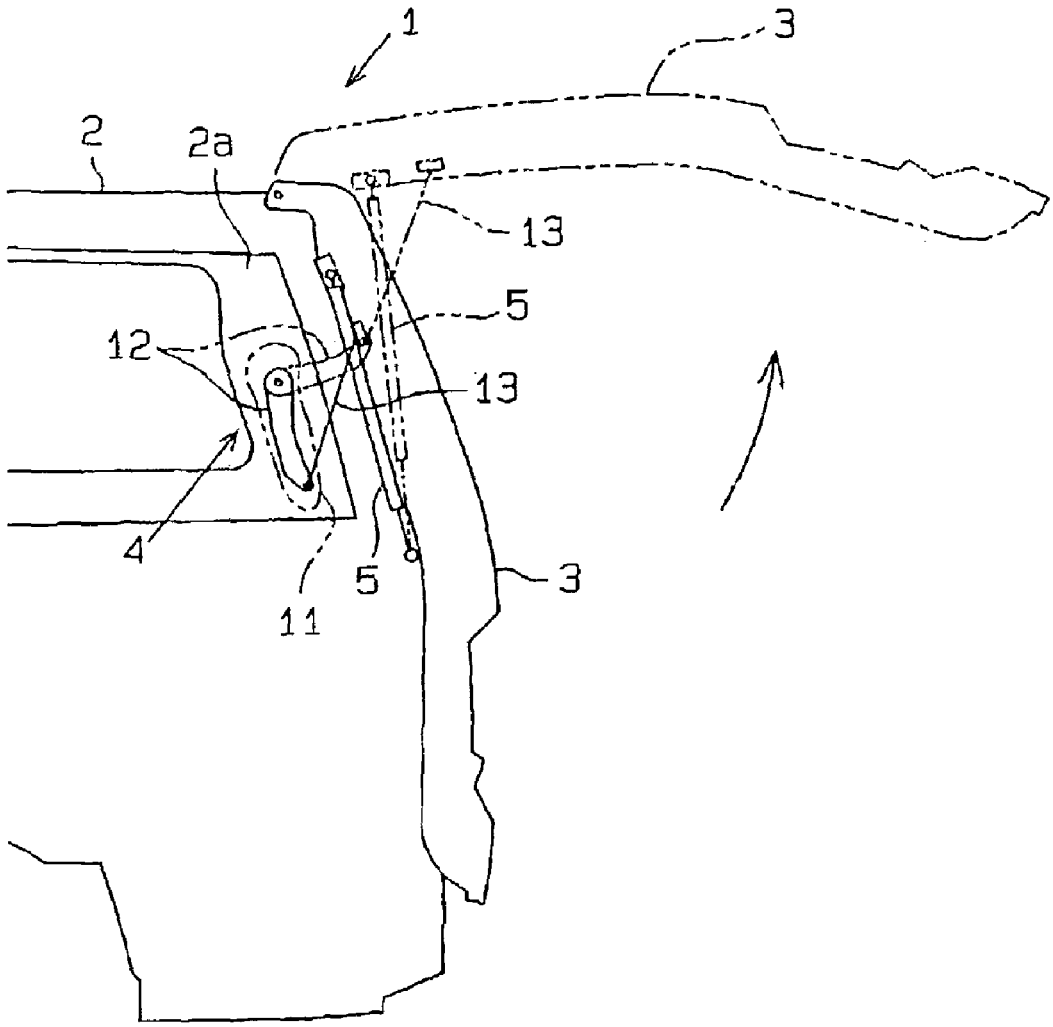
FIG. 4 is an over view of the opening and closing device according to the first embodiment of the present invention.

A first embodiment of an opening and closing device will be explained with respect to the drawing figures of FIGS. 1–4. As shown in FIG. 4, an electric backdoor system 1 includes a backdoor 3 serving as a movable member connected to a top rear portion of a vehicle body 2 with a hinge, an actuator 4 for electrically opening and closing the backdoor 3, and a damper stay 5 serving as a shock absorbing member.

The actuator 4 includes a drive unit 11 secured to a rear pillar 2*a* of the vehicle body 2, an arm 12 serving as a dynamic transmission mechanism connected to an output shaft of the drive unit 11 to be unitarily rotated, and a rod 13 for connecting a tip end portion of the arm 12 and a base end portion of the backdoor 3. The rod 13 is connected to the tip end portion of the arm 12 and the base end portion of the backdoor 3 via a ball joint construction 7 (shown in FIG. 8) respectively so that the displacement is allowed while rotating.

Under the closed state of the backdoor 3, the tip end side of the arm 12 is arranged to be positioned on a first side (i.e., bottom side of FIG. 4). In accordance with this, the rod 13 is folded. On the other hand, under the state that the backdoor 3 is open, the arm 12 is rotated in one direction (i.e., counterclockwise direction of FIG. 4) to position the tip end side of the arm 12 on a second side (i.e., right side of FIG. 4). Accordingly, the rod 13 is pushed to support the backdoor 3 under the open state. By moving the arm 12 between the foregoing two states by driving the drive unit 1, the backdoor 3 is opened and closed.

The damper stay 5 includes a gas piston injected with the high pressure gas. One end and the other end of the damper stay 5 are connected to the rear portion of the vehicle body 2 and the base end portion of the backdoor 3 respectively. The damper stay 5 generated the resultant force in the closing direction added with the weight of the backdoor 3 per se during the first half of the operation for opening the backdoor 3 to prevent the sudden door opening. On the other hand, the damper stay 5 assists to open the door by generating the resultant force in the opening direction along with the weight of the backdoor 3 per se during the last half of the opening operation of the backdoor 3. In other words, the damper stay 5 adds the force either one of in the closing direction or the opening direction to the backdoor 3 with reference to the position balancing the generated force and the weight of the backdoor 3 per se. By the fluctuation of the force applied to the backdoor 3, the rotational direction affecting the arm 12 and the drive unit 11 connected to the backdoor 3 via the rod 13 is fluctuated.

Figure 1:
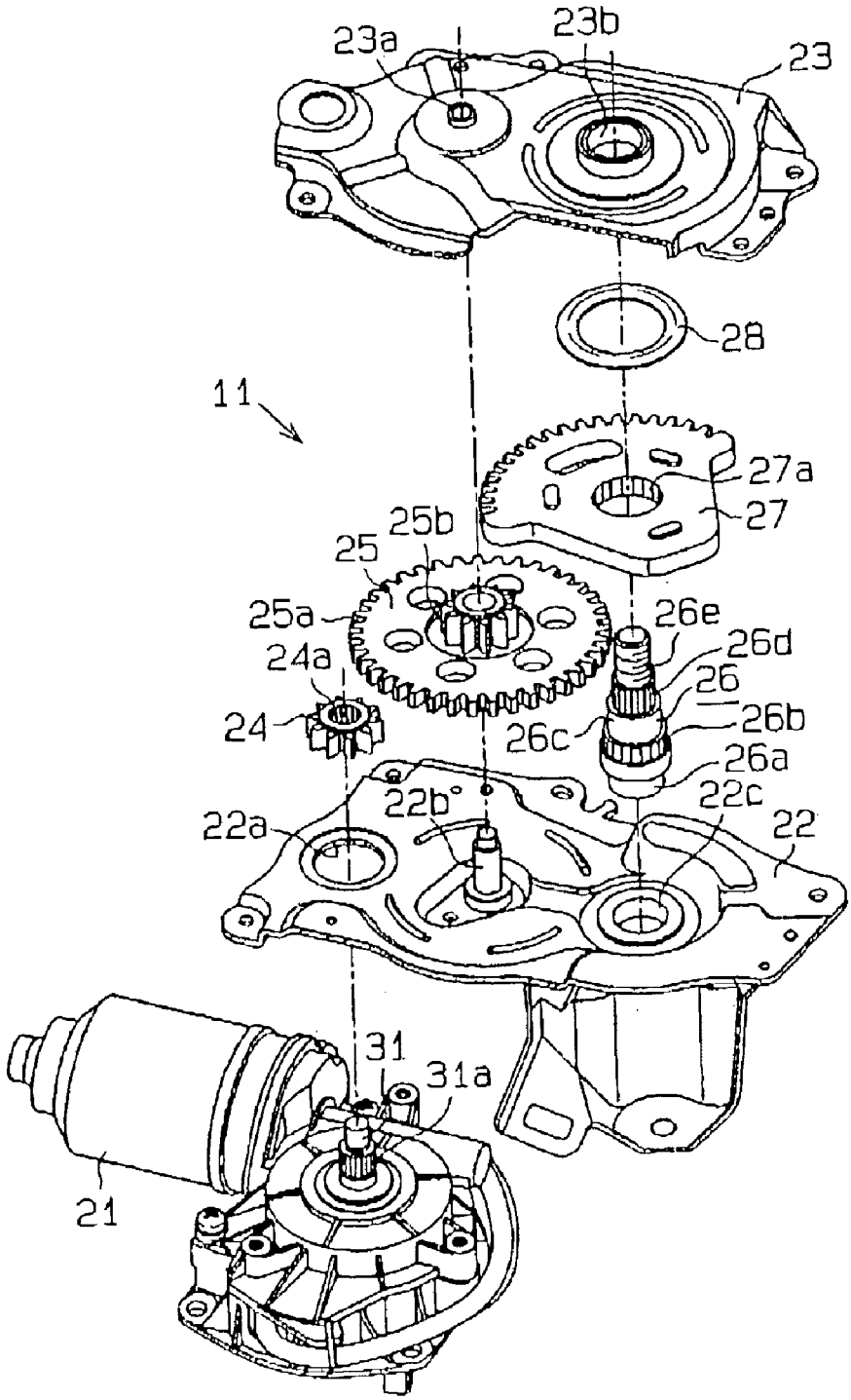
FIG. 1 shows a perspective exploded view of an opening and closing device according to a first embodiment of the present invention.

The configuration of the drive unit 11 and the arm 12 will be explained with reference to FIGS. 1–3. As shown in FIGS. 1–3, the drive unit 11 includes an electric motor 21 with decelerator serving as a drive source, a lower case 22 and an upper case 23 serving as an improvable portion (or a fixed housing), a motor side gear 24, a drive gear 25, a rotational shaft 26, a driven gear 27, and a rubber ring serving as a frictional member.

The electric motor 21 with the decelerator accommodates the decelerator including a worm and a worm wheel. An output shaft 31 of the electric motor 21 with a decelerator is projected on one side (i.e., top side of FIG. 1). A serration 31*a* is provided on the output shaft 31.

The lower case 22 is configured being approximately stepped plate shape. The lower case 22 is formed with a bore 22*a* to be inserted with the output shaft 31. The lower case 22 is provided with the shaft potion 22*b* projected to one side (i.e., top side of FIG. 1) corresponding to the drive gear 25. Further, the lower case 22 is formed with a bearing bore 22*c* formed corresponding to the rotation shaft 26. The rotational shaft 26 is rotatably supported by the lower case 22 by being inserted into the bearing bore 22*c*.

The motor side gear 24 is provided with a bore and is fitted on the output shaft 31, so that the output shaft 31 passes through the bore. The motor side gear 24 is positioned in the inserting bore 22*a* of the lower case 22. A serration 24*a* is formed on the internal peripheral surface of the bore in the motor side gear 24 and is adopted to engage the serration 31*a* on the output shaft 31. The motor side gear 24 is thus unitarily rotated with the output shaft 31 by virtue of the engagement of the serration 24*a* with the serration 31*a* of the output shaft 31.

The drive gear 25 is rotataby supported by the lower case 22 via the shaft portion 22*b* of the lower case 22. The drive gear 25 includes a first gear portion 25*a* having larger diameter than that of the motor side gear 24 and a second gear portion 25*b* having a smaller diameter than that of the first gear portion 25*a*. The first gear portion 25*a* of the drive gear 25 is geared with the motor side gear 24 and thus the drive gear 25 is rotatably driven by the electric motor 21 with the decelerator.

The rotational shaft 26 is formed in approximately stepped pillar shape. A first shaft portion 26*a* of the base end side (i.e., bottom side of FIG. 1) is inserted into the bearing bore 22*c* of the lower case 22 so that the rotational shaft 26 is rotatably supported by the lower case 22. The rotation shaft 26 is configured to have steps whose diameters being reduced from the first shaft portion 26*a* to a tip end side. The rotational shaft 26 includes a first serration shaft portion 26*b*, a second shaft portion 26*c*, a second serration shaft portion 26*d*, and a screw portion 26*e*. The driven gear 27 is secured to the first serration shaft portion 26*b* and the arm 12 is secured to the second serration shaft portion 26*d*.

The driven gear 27 has a sector gear construction configured to have a portion of a circumference and is connected to the rotation shaft 26 for unitary rotating with the rotation shaft 26. The driven gear 27 is formed with the penetration bore penetrated in the axial direction and an internal peripheral surface of the penetration bore is formed with a serration 27*a* corresponding to the serration of the first serration shaft portion 26*b*. Accordingly, the driven gear 27 is connected to the rotations shaft 26 to be unitary rotatable by securing the serration 27*a* to the serration of the first serration shaft portion 26*b*. The driven gear 27 is geared with the second gear portion 25*b* of the drive gear 25 so that the driven gear 27 is rotated by the drive gear 25 along with the rotation shaft 26.

The rubber ring 28 is configured to be approximately circular shape having an internal diameter larger than the internal diameter of the serration 27*a* of the driven gear 27. The rubber ring 28 is penetrated to be placed in approximately coaxial to the rotation shaft 26 surrounding the second shaft portion 26*c* of the rotation shaft 26 projected to one side to be connected to the driven gear 27. The rubber ring 28 is provided between the driven gear 27 and the uppercase 23.

The upper case 23 is formed in the approximately stepped place shape. An inserting bore 23*a* being inserted with the tip end portion of the shaft portion 22*b* penetrating through the driven gear 25 is formed on the upper case 23. Thus, the drive gear 25 is accommodated between the opposing surfaced between the lower case 22 and the upper case 23 and the movement of the drive gear 25 in the axial direction is restricted. The upper case 23 is provided with a bearing bore 23*b* formed corresponding to a tip end portion of the second shaft portion 26*c* inserted into the rubber ring 28. The rotation shaft 26 is inserted into the bearing bore 23*b* to be rotatably supported by the upper case 23. Thus, the rotation shaft 26 is rotatably supported between the lower case 22 and the upper case 23 along with the driven gear 27.

As shown in FIG. 2, the arm 12 is fitted through the shaft bore 23*b* of the upper case 23 to be secured to the second serration shaft portion 26*d* of the rotation shaft 26 projected to one side (i.e., top side of FIG. 2) to be unitarily rotated with the rotation shaft 26. More specifically, a sleeve 12*a* projected in the axial direction corresponding to the rotation shaft 26 (i.e., second serration shaft portion 26*d*) is secured to the base portion of the arm 12 and a serration 12*b* is formed in an internal peripheral surface of the sleeve 12*a* corresponding to the serration of the second serration shaft portion 26*d*. By fitting the serration 12*b* to the serration of the rotation shaft 26 (i.e., the second serration shaft portion 26*d*), the arm 12 is configured to be unitarily rotated with the rotation shaft 26. A nut 32 is screwed on a screw portion 26*e* of the rotation shaft 26 projected to the one side (i.e., top side of FIG. 2) after fitting the arm 12.

With the foregoing construction, when the output shaft 31 is rotated in one direction by supplying the power to the electric motor 21 with the decelerator, the rotation is transmitted to the arm 12 via the motor side gear 24, the drive gear 25 (i.e., the first gear portion 25*a* and the second gear portion 25*b*), and the driven gear 27. Thus, the rotation of the arm 12 is transmitted to the backdoor 3 via the rod 13 for moving the backdoor either in the opening direction or in the closing direction depending on the rotational direction of the arm 12 (shown in FIG. 4).

Provided that the direction of the rotational force urging the driven gear 27 via the arm 12 and the rod 13 in accordance with the resultant force of the force from the damper stay 5 and the weight of the backdoor 3 per se is fluctuated (shown in FIGS. 9*a*, 9*b*). In this case, the drastic change of the urged rotational direction is restrained by the sliding resistance by the rubber ring 28. In addition, because the movement of the driven gear 27 relative to the driven gear 25 within the range of the backlash is restrained, the undesirable sudden swinging movement due to the sudden movement of the backdoor 3 can be restrained.

According to the embodiment of the present invention, the rubber ring 28 is provided between the driven gear 27 and the upper case 23. Thus, even when the direction of the urged rotational force affecting the driven gear 27 via the rod 13 and the arm 12 in accordance with the resultant force of the force of the damper stay 5 and the weight of the backdoor 3 is fluctuated, the sudden change of the urged rotational direction can be restrained by the sliding resistance of the rubber ring 28. In addition, because the movement of the driven gear 27 relative to the drive gear 25 within the backlash range is restrained, the undesirable sudden swinging movement due to the sudden movement of the backdoor 3 can be restrained. Thus, the opening and closing operation of the backdoor 3 can be performed smoothly.

According to the embodiment of the present invention, the rubber ring 28 can be provided by using the existing housing (i.e., upper case 23) for accommodating the driven gear 27. Thus, the burden at design change can be mitigated.

According to the embodiment of the present invention, the rubber ring 28 is positioned approximately coaxial to the driven gear 27. This absorbs the movement of the driven gear 27 in the axial direction.

According to the embodiment of the present invention, the movement within the range of the backlash can be swiftly performed during the initial stage by providing the rubber ring 28 for restraining the sudden change of the urged rotational direction in the drive unit 11 on a portion closest to a final deceleration portion of the drive unit 11, that is, the loaded side (i.e., backdoor 3). Embodiment is not limited to the above-explained embodiment and can be varied as follows.

Figure 5:
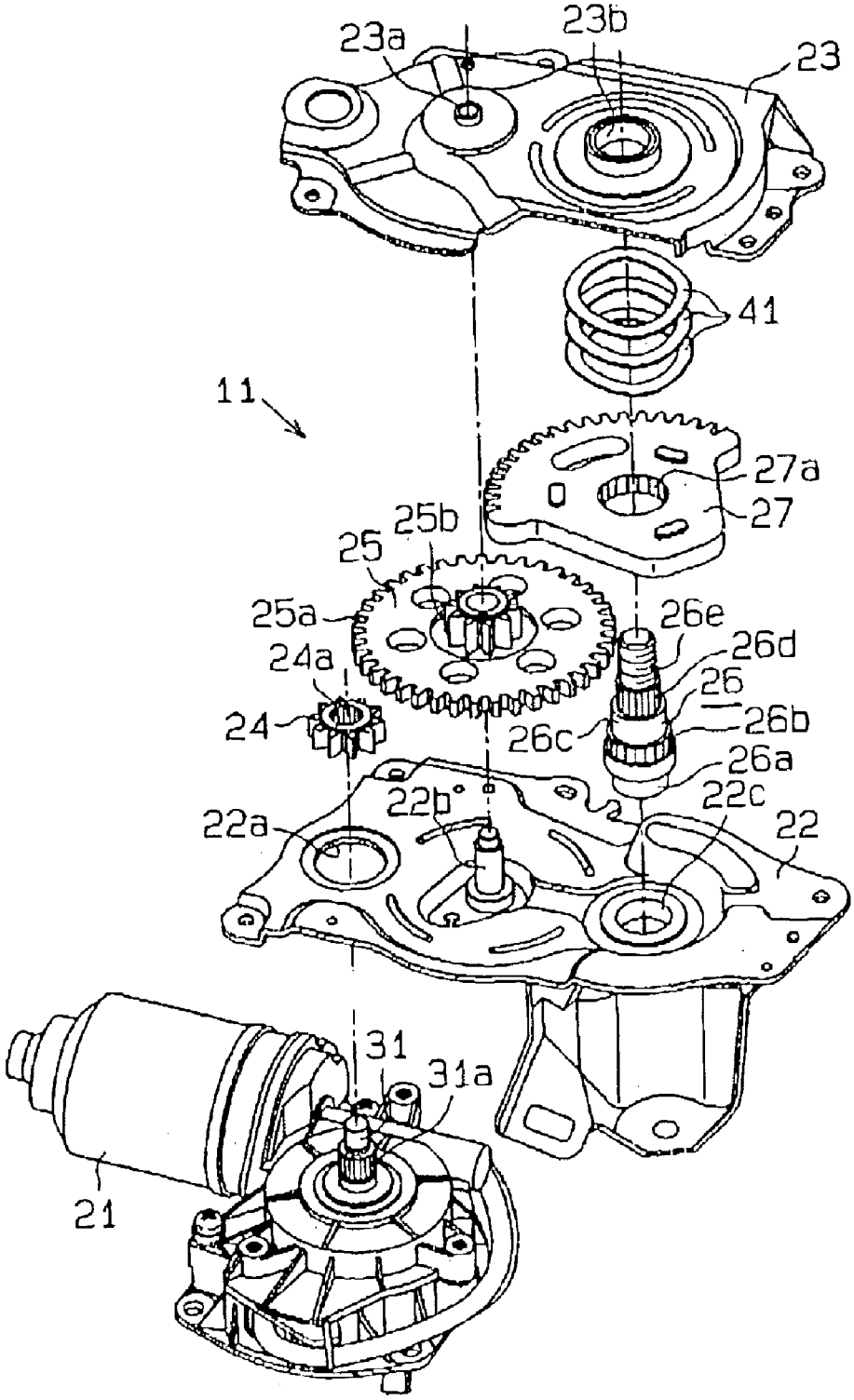
FIG. 5 is a perspective exploded view of an opening and closing device according to a second embodiment of the present invention.
Figure 6:
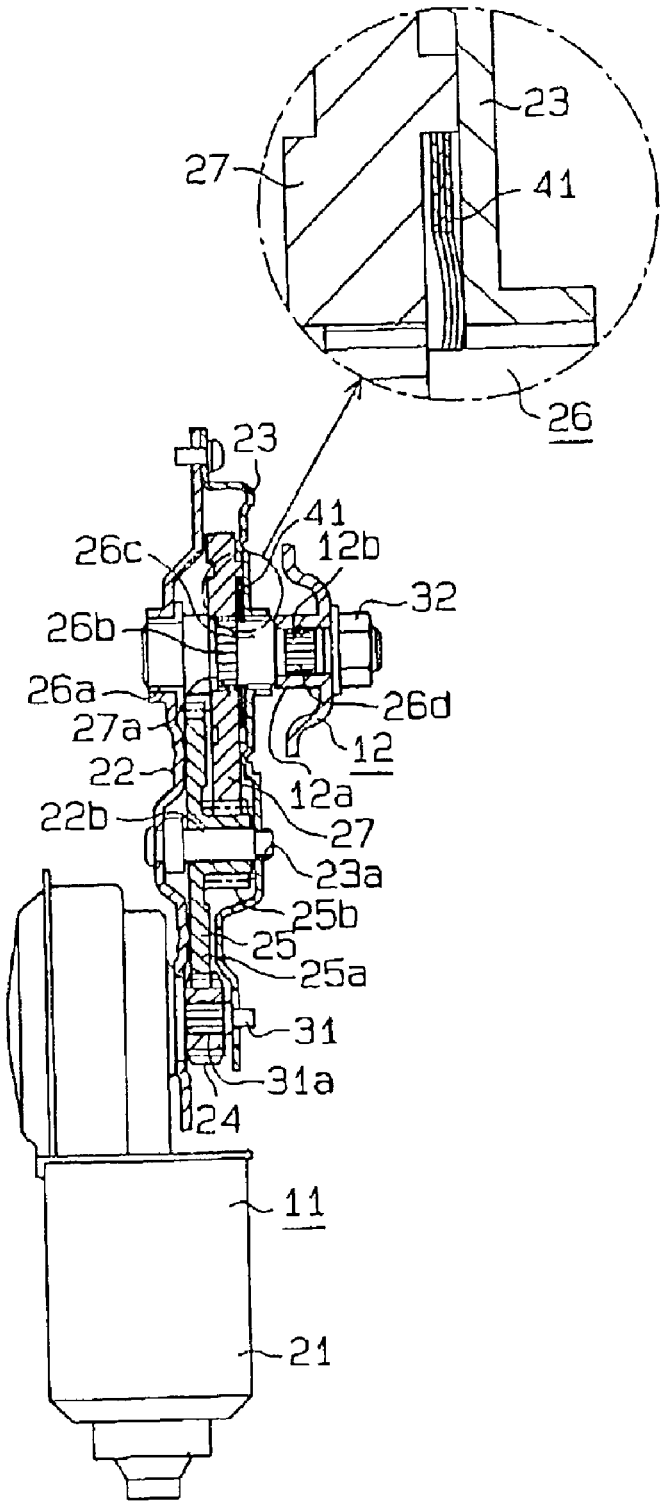
FIG. 6 is a cross sectional view of the opening and closing device according to the second embodiment of the present invention.

With the first embodiment of the present invention, the rubber ring 28 is provided as the friction member. Instead of the rubber ring 28, a wave washer 41 (serving as spring ring) may be provided as the friction member as shown in FIGS. 5–6. Although a plurality of (i.e., three) wave washers 41 are piled as shown in FIGS. 5–6, the number of the wave washers 41 is not limited to three as long as generating the favorable sliding resistance by the elastic force. In place of the wave washer 41, a coned disc spring or a coil spring may be applied.

Although the annular shape friction member such as the rubber ring 28 and the wave washer 41 are applied in the foregoing embodiment, the configuration of the friction member is not limited to the annular shape. For example, a rubber plate serving as the friction member can be provided between the upper case 23 and the driven gear 27.

According to the embodiment, the friction member such as the rubber ring 28 and the wave washer 41 is provided between the upper case 23 and the driven gear 27. However, the friction member may be provided between the upper case 23 and the arm 12. The rotational shaft 26 may be provided with a flange or the like opposing to the upper case 23 and the friction member may be provided between the flange or the like and the upper case 23.

Although the friction member such as the rubber ring 28 and the wave washer 41 is provide between the upper case 23 and the driven gear 27 in the foregoing embodiment, the friction member may be provided between the lower case 22 and the driven gear 27.

Although the rotation shaft 26 and the driven gear 27 are provided individually and the rotation shaft 26 and the driven gear 27 are connected in the foregoing embodiment, the rotation shaft 26 and the driven gear 27 may be formed as in one unit. By constructing the rotation shaft 26 and the driven gear 27 as one unit, the number of the parts is reduced in addition to obtaining other effects.

The position for applying the friction member such as the rubber ring 28 and the wave washer 41 is not limited to one and the optimal effect may be obtained by applying the frictional member at plural positions.

According to a third embodiment of the present invention, instead of the rubber ring 28 and the wave washer 41 serving as the friction member, high viscous grease may be applied as the friction member. By selecting high viscous grease with the low worked penetration degree defined in Japanese Industrial Standard (JIS) K2220 is equal to or less than 250 (i.e., the smaller degree number of the worked penetration indicates the higher viscosity), the better effect can be obtained. Because this method is applicable to the product without changing the parts, the manufacturing cost can be reduced.

Figure 7:
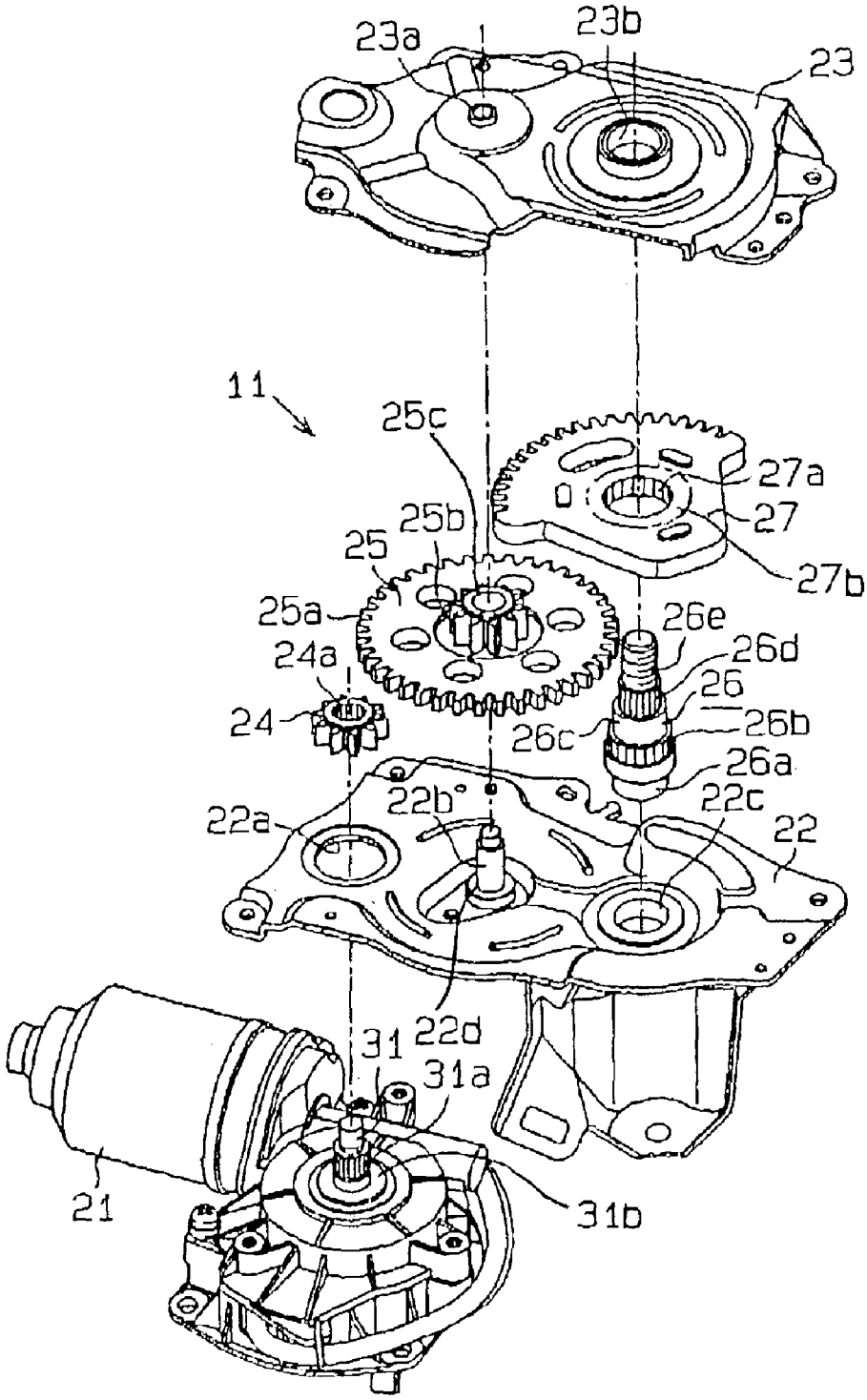
FIG. 7 is a perspective exploded view of an opening and closing device for particularly indicating portions applied with high viscosity grease according to a third embodiment of the present invention.

As shown in FIG. 7, the high viscous grease may be applied to one of or a plurality of portions indicated as movable portions 27*b*, 25*c*, 22*d*, 31*b*.

Figure 8:
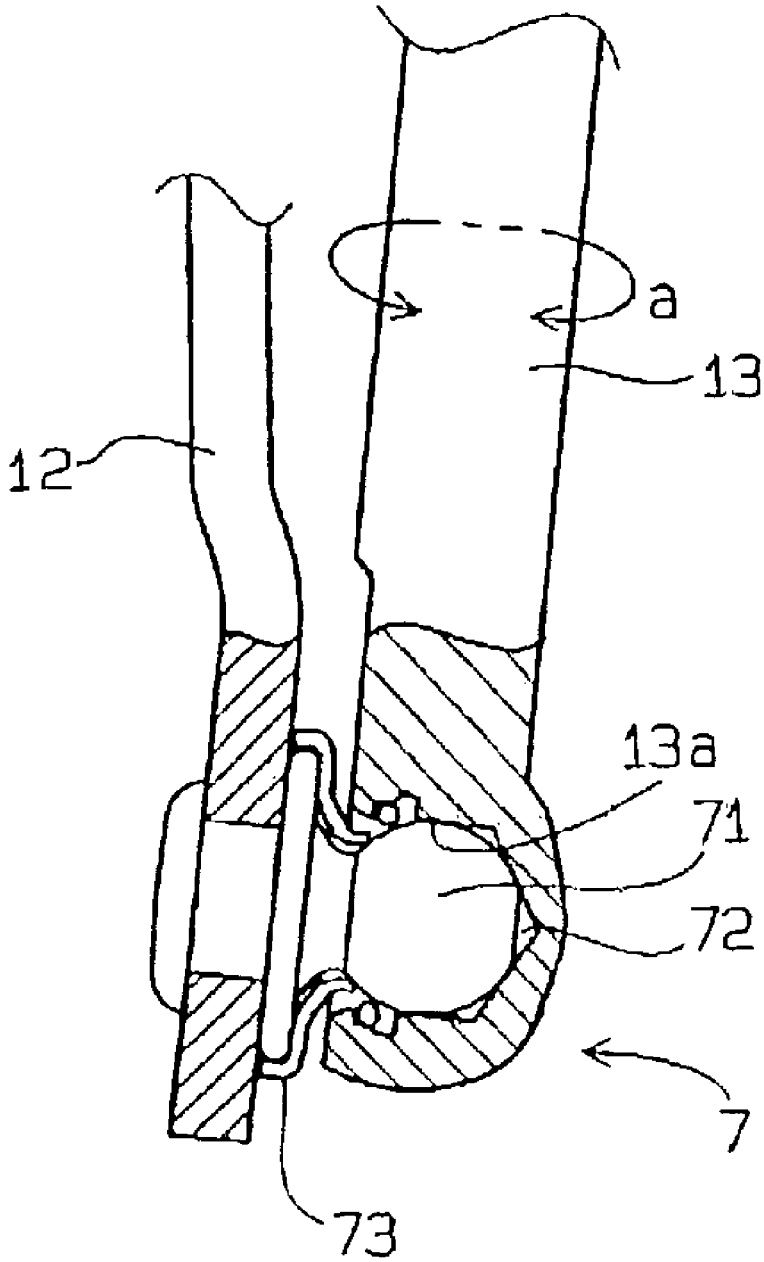
FIG. 8 is a cross sectional view taken on line VIII—VIII of FIG. 3.

A fourth embodiment of the present invention will be explained as follows. With the foregoing embodiments, the method for providing the friction member in the drive unit 11 or to the drive unit 11 and the arm 12 in order to solve the drawbacks that the swing is generated by the sudden movement of the backdoor at the changing portion of the load affecting deriving from the backlash between gears. Likewise, as explained from the transmission mechanism of the operation force from the drive unit 11 to the backdoor 3, in case there is a play for the connection at the ball joint mechanism 7 for connecting the arm 12 and the rod 13, the phenomenon that the backdoor is suddenly moved is generated. In order to solve the drawback, as shown in FIG. 8, a clearance 72 for pooling the grease is provided between a bearing portion 13*a* of the ball joint mechanism 7 formed on the end portion of the rod 13 and a ball 71 fixed to the arm side. By sealing the high viscous grease into the clearance 72, the sudden load change due to the play can be restrained. Further, by providing a shock absorbing member 73 to prevent the noise generated by the interference between the arm 12 and the rod 13 by the rotation of the rod 13 in the direction shown with an arrow a in FIG. 8, further favorable effect can be obtained.

Although the drive force of the drive unit 11 (i.e., driven gear 27) is transmitted to the backdoor 3 via the arm 12 and the rod 13 in the foregoing embodiments, other constructions may be applied.

The construction of the electric motor 21 with the decelerator side for transmitting the dynamic to the drive gear 25 of the drive unit 11 is an example and other construction may be applied.

Although the embodiments of the present invention is applied to the electric backdoor system 1, the embodiment of the present invention may be applied to a system for electrically opening and closing a gull wing door which upwardly flips the side doors of the vehicle.

Although the embodiment of the present invention is applied to the movable member (i.e., backdoor 3) having the damper stay 5, the damper stay 5 is not always necessary. For example, the direction of the rotation force affecting the driven gear 27 is changed depending on the relationship between the rotation range of the movable member and the gravity direction only by the weight of the movable member per se without the assist of the damper stay 5. Accordingly, the same effects can be obtained even in this case.

Although the spring ring, the rubber ring, and the high viscous grease serving as the friction member are applied separately in the embodiments, any combination of the spring ring, the rubber ring, and the high viscous grease is applicable.

According to the embodiment of the present invention, the smooth opening and closing operation can be performed by restraining the swing of the movable member.

According to the embodiment of the present invention, the friction member can be applied using the existing hosing. Thus, the load for design change can be mitigated.

According to the embodiment of the present invention, by positioning the friction member coaxial to the driven gear, the vibration of the driven gear in the axial direction can be absorbed.

The principles, preferred embodiment and mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An opening and closing device for moving a movable member comprising:

a drive gear connected to a power source;

a driven gear geared with the drive gear;

an immovable portion supporting the drive gear and the driven gear;

a dynamic transmission mechanism, connected to the driven gear so that the driven gear and the dynamic transmission mechanism rotate together as a unit, the dynamic transmission mechanism transmitting a drive force of the power source from the driven gear to the movable member; and a shock absorbing member for applying a force to the movable member in accordance with a state of the movable member; wherein a direction of a rotational force affecting the driven gear via the dynamic transmission mechanism in accordance with a resultant force from a weight of the movable member and the shock absorbing member fluctuates;

a friction member applied at least at one position between relatively movable facing surfaces of the immovable portion, the drive gear, the driven gear, and the dynamic power transmission mechanism.

2. An opening and closing device according to claim 1, wherein the immovable portion is a housing accommodating the driven gear.

3. An opening and closing device according to claim 2, wherein the friction member includes at least one of a spring ring, a rubber ring, and a high viscous grease, or any combination thereof.

4. An opening and closing device according to claim 1, wherein the friction member includes at least one of a spring ring, a rubber ring, and a high viscous grease, or any combination thereof.

5. An opening and closing device according to claim 1, wherein the immovable portion includes a housing and the dynamic transmission mechanism includes an arm.

6. An opening and closing device according to claim 5, wherein the friction member includes at least a wave washer.

7. An opening and closing device according to claim 5, wherein the friction member includes at least one of a spring ring, a rubber ring, and a high viscous grease, or any combination thereof.

* * * * *